US006798350B2

(12) United States Patent
Maxit et al.

(10) Patent No.: US 6,798,350 B2
(45) Date of Patent: Sep. 28, 2004

(54) METHOD FOR REPEATING MESSAGES IN LONG INTELLIGENT COMPLETION SYSTEM LINES

(75) Inventors: Jorge O. Maxit, Houston, TX (US); Izhar Ahmad, Sugar Land, TX (US); Don A. Hopmann, La Porte, TX (US); Dan Cousin, Houston, TX (US); Terry A. Gibson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 10/126,802

(22) Filed: Apr. 19, 2002

(65) Prior Publication Data

US 2002/0179303 A1 Dec. 5, 2002

Related U.S. Application Data

(60) Provisional application No. 60/287,649, filed on Apr. 30, 2001.

(51) Int. Cl.[7] ..... G01V 3/00

(52) U.S. Cl. ..... 340/853.3; 340/853.1; 340/853.7; 175/50; 166/250.01; 166/369

(58) Field of Search ..... 340/853.3, 853.1, 340/853.7; 166/250.01, 369; 175/50

(56) References Cited

U.S. PATENT DOCUMENTS 4,472,968 A 9/1984 Coates
4,862,426 A 8/1989 Cassity et al. ..... 367/81
5,293,937 A 3/1994 Schultz et al. ..... 166/250
5,456,316 A 10/1995 Owens et al. ..... 166/250.01
5,730,219 A 3/1998 Tubel et al. ..... 66/250.01
5,959,547 A * 9/1999 Tubel et al. ..... 340/853.2
6,252,518 B1 * 6/2001 Laborde ..... 340/855.4
6,630,890 B1 * 10/2003 Endo et al. ..... 340/853.9
6,693,553 B1 * 2/2004 Ciglenec et al. ..... 340/853.1

FOREIGN PATENT DOCUMENTS

EP 0972909 A2 1/2000

* cited by examiner

*Primary Examiner*—Albert K. Wong
(74) *Attorney, Agent, or Firm*—Madan, Mossman & Sriram, P.C.

(57) ABSTRACT

A method for two-way communication for controlling production from a formation having at least one producing well and a plurality of producing zones. In one embodiment, the method comprises installing a flow control device with a controller proximate each of the producing zones, where each controller has a predetermined communication address, and each controller is adapted to act as a repeater on command from a surface controller; connecting each controller to a transmission bus where the transmission bus is connected to the surface controller; transmitting a command message from the surface controller to a predetermined downhole controller, where the command message determines a predetermined path along the transmission bus according to a predetermined protocol; receiving the command message by the predetermined controller; and executing the command message to control the flow control device. Transmitting a response message back along the predetermined path.

18 Claims, 7 Drawing Sheets

METHOD FOR REPEATING MESSAGES IN LONG INTELLIGENT COMPLETION SYSTEM LINES

This application claims the benefit of U.S. Provisional Application No. 60/287,649 filed on Apr. 30, 2001.

BACKGROUND OF THE INVENTION

1. Field of the Invention

This invention relates generally to a method for the control of oil and gas production wells. More particularly, it relates to a communication protocol for a multi-well, multi-zone control system for providing communications signals between components of the system to ensure that each component reliably receives communications intended for it.

2. Description of the Related Art

The control of oil and gas production wells constitutes an on-going concern of the petroleum industry due, in part, to the enormous monetary expense involved as well as the risks associated with environmental and safety issues.

Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well. Before describing the current state-of-the-art relative to such production well control systems and methods, a brief description will be made of the production systems, per se, in need of control. One type of production system utilizes electrical submersible pumps (ESP) for pumping fluids from downhole. In addition, there are two other general types of productions systems for oil and gas wells, namely plunger lift and gas lift. Plunger lift production systems include the use of a small cylindrical plunger which travels through tubing extending from a location adjacent the producing formation down in the borehole to surface equipment located at the open end of the borehole. In general, fluids which collect in the borehole and inhibit the flow of fluids out of the formation and into the wellbore, are collected in the tubing. Periodically, the end of the tubing is opened at the surface and the accumulated reservoir pressure is sufficient to force the plunger up the tubing. The plunger carries with it to the surface a load of accumulated fluids which are ejected out the top of the well thereby allowing gas to flow more freely from the formation into the wellbore and be delivered to a distribution system at the surface. After the flow of gas has again become restricted due to the further accumulation of fluids downhole, a valve in the tubing at the surface of the well is closed so that the plunger then falls back down the tubing and is ready to lift another load of fluids to the surface upon the reopening of the valve.

A gas lift production system includes a valve system for controlling the injection of pressurized gas from a source external to the well, such as another gas well or a compressor, into the borehole. The increased pressure from the injected gas forces accumulated formation fluids up a central tubing extending along the borehole to remove the fluids and restore the free flow of gas and/or oil from the formation into the well. In wells where liquid fall back is a problem during gas lift, plunger lift may be combined with gas lift to improve efficiency.

In both plunger lift and gas lift production systems, there is a requirement for the periodic operation of a motor valve at the surface of the wellhead to control either the flow of fluids from the well or the flow of injection gas into the well to assist in the production of gas and liquids from the well. These motor valves are conventionally controlled by timing mechanisms and are programmed in accordance with principles of reservoir engineering which determine the length of time that a well should be either "shut in" and restricted from the flowing of gas or liquids to the surface and the time the well should be "opened" to freely produce. Generally, the criteria used for operation of the motor valve is strictly one of the elapse of a preselected time period. In most cases, measured well parameters, such as pressure, temperature, etc. are used only to override the timing cycle in special conditions.

It will be appreciated that relatively simple, timed intermittent operation of motor valves and the like is often not adequate to control either outflow from the well or gas injection to the well so as to optimize well production. As a consequence, sophisticated computerized controllers have been positioned at the surface of production wells for control of downhole devices such as the motor valves.

In addition, such computerized controllers have been used to control other downhole devices such as hydro-mechanical safety valves. These typically microprocessor based controllers are also used for zone control within a well and, for example, can be used to actuate sliding sleeves or packers by the transmission of a surface command to downhole microprocessor controllers and/or electromechanical control devices.

The surface controllers are often hardwired to downhole sensors which transmit information to the surface such as pressure, temperature and flow. This data is then processed at the surface by the computerized control system. Electrically submersible pumps use pressure and temperature readings received at the surface from downhole sensors to change the speed of the pump in the borehole. As an alternative to downhole sensors, wire line production logging tools are also used to provide downhole data on pressure, temperature, flow, gamma ray and pulse neutron using a wire line surface unit. This data is then used for control of the production well.

A problem associated with known control systems is the reliability of surface to downhole signal integrity. It will be appreciated that should the surface control signal be in any way compromised on its way downhole, then important control operations will not take place as needed. As distances between the surface system and downhole controllers increases, the signal is attenuated and may fall below a level required for reliable communication.

SUMMARY OF THE INVENTION

The methods and apparatus of the present invention overcome the foregoing disadvantages of the prior art by providing a reliable method of communication for a multi-well, multizone completion system.

In one aspect, a method for controlling production from a formation having at least one producing well disposed therein, the at least one producing well having a plurality of producing zones, comprises; installing a flow control device with a controller proximate each of the producing zones where each controller has a predetermined communication address, and each controller is adapted to act as a repeater on command from a surface controller; connecting each controller to a transmission bus, where the transmission bus is connected to the surface controller; transmitting a command message from the surface controller to a predetermined controller, where the command message determines a predetermined path along the transmission bus according to a predetermined protocol; receiving the command message by the predetermined controller; and executing the command message to control the flow control device.

In another aspect of the present invention, a method involves transmission of a command message from a master node, through at least one repeater node, to a destination node, each node having a separate unique address to ensure that the message is repeated, received, and executed only by the intended nodes. The method comprises transmitting a command message on a communication bus from a master node, having the message relayed by at least one repeater node to a destination node. The command message comprises a command synchronization string, a command origin address, at least one repeater address, and a destination address. The path of the message is determined by routing information in the address of each node in the header. The destination node interprets and executes the message and sends a response message by modifying the routing bits to retrace the path of the command message. The response message is received and interpreted by the master node and used by the surface system to control the well production.

In another preferred embodiment, the method involves transmission of a command message from a master node to a destination node, each node having a separate unique address to ensure that the message is received, and executed only by the intended node. The method comprises transmitting a command message on a communication bus from a master node to a destination node. The command message comprises a command synchronization string, a command origin address and a destination address. The path of the message is determined by routing information in the address of each node in the header. The destination node interprets and executes the message and sends a response message by modifying the routing bits to retrace the path of the command message. The response message is received and interpreted by the master node and used by the surface system to control the well production.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

The downhole Intelligent Completion System(ICS) is composed of downhole sensors, downhole control electronics and downhole electromechanical modules that can be placed in different locations (e.g., zones) in a well, with each downhole control system having a unique electronic address. A number of wells can be outfitted with these downhole control devices. The surface control and monitoring system interfaces with all of the wells where the downhole control devices are located to poll each device for data related to the status of the downhole sensors attached to the module being polled. In general, the surface system allows the operator to control the position, status, and/or fluid flow in each zone of the well by sending a command to the device being controlled in the wellbore.

Figure 1:
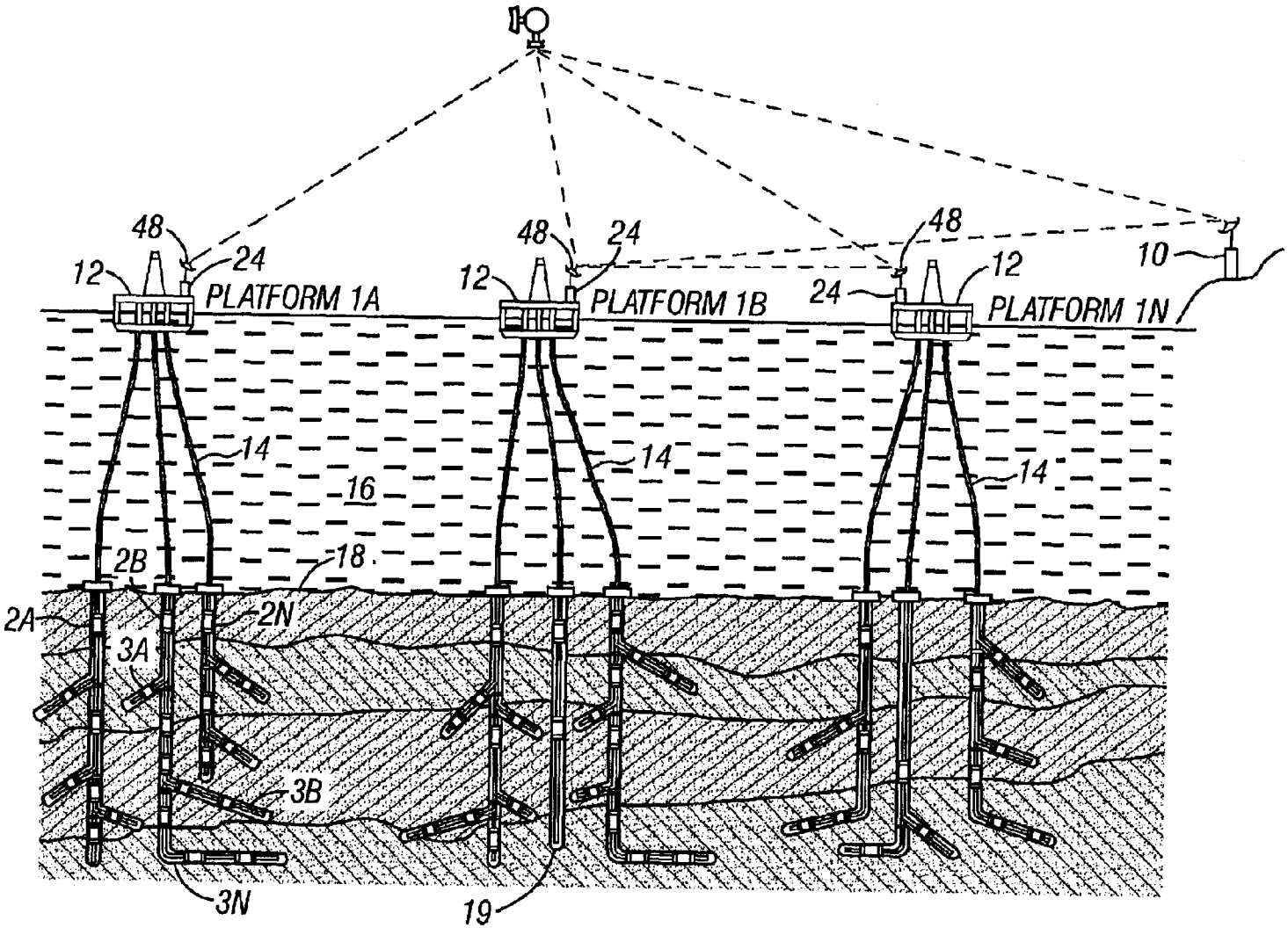
FIG. 1 is a diagrammatic view depicting a multiwell/multizone control system for controlling a plurality of offshore wells according to one embodiment of the present invention.

Referring to FIG. 1, the multiwell/multizone monitoring and control system of the ICS may include a remote central control center 10 which communicates either wirelessly or via telephone wires to a plurality of well platforms 12. Any number of well platforms may be encompassed by the control system with three platforms namely, platform 1A, platform 1B, and platform 1N being shown in FIG. 1. Each well platform has associated therewith a plurality of wells 14 which extend from each platform 12 through water 16 to the surface of the ocean floor 18 and then downwardly into formations under the ocean floor. It will be appreciated that while offshore platforms 12 have been shown in FIG. 1, the group of wells 14 associated with each platform are analogous to groups of wells positioned together in an area of land; and the present invention therefore is also well suited for use with land based wells.

As mentioned, each platform 12 is associated with a plurality of wells 14. For purposes of illustration, three wells are depicted as being associated with platform number 1A with each well being identified as well number 2A, well number 2B and well number 2N. As is known, a given well may be divided into a plurality of separate zones which are required to isolate specific areas of a well for purposes of producing selected fluids, preventing blowouts and preventing water intake. Such zones may be positioned in a single vertical well such as well 19 associated with platform 1B shown in FIG. 1 or such zones can result when multiple wells are linked or otherwise joined together. A particularly significant contemporary feature of well production is the drilling and completion of lateral or branch wells which extend from a particular primary wellbore. These lateral or branch wells can be completed such that each lateral well constitutes a separable zone and can be isolated for selected production.

Figure 2:
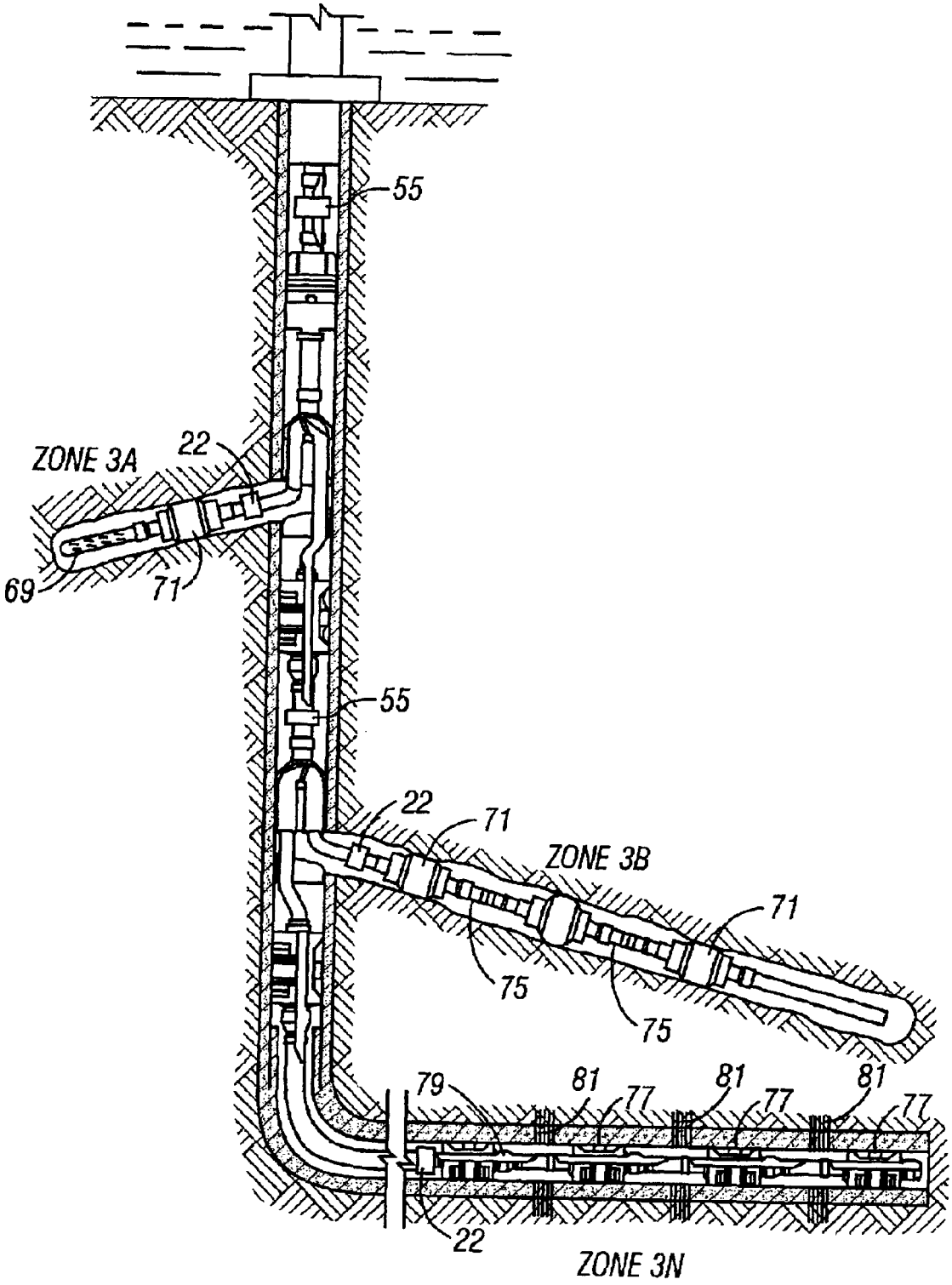
FIG. 2 is a diagrammatic view of a portion of FIG. 1 depicting a selected well and selected zones in the selected well and a downhole control system according to one embodiment of the present invention.
Figure 3:
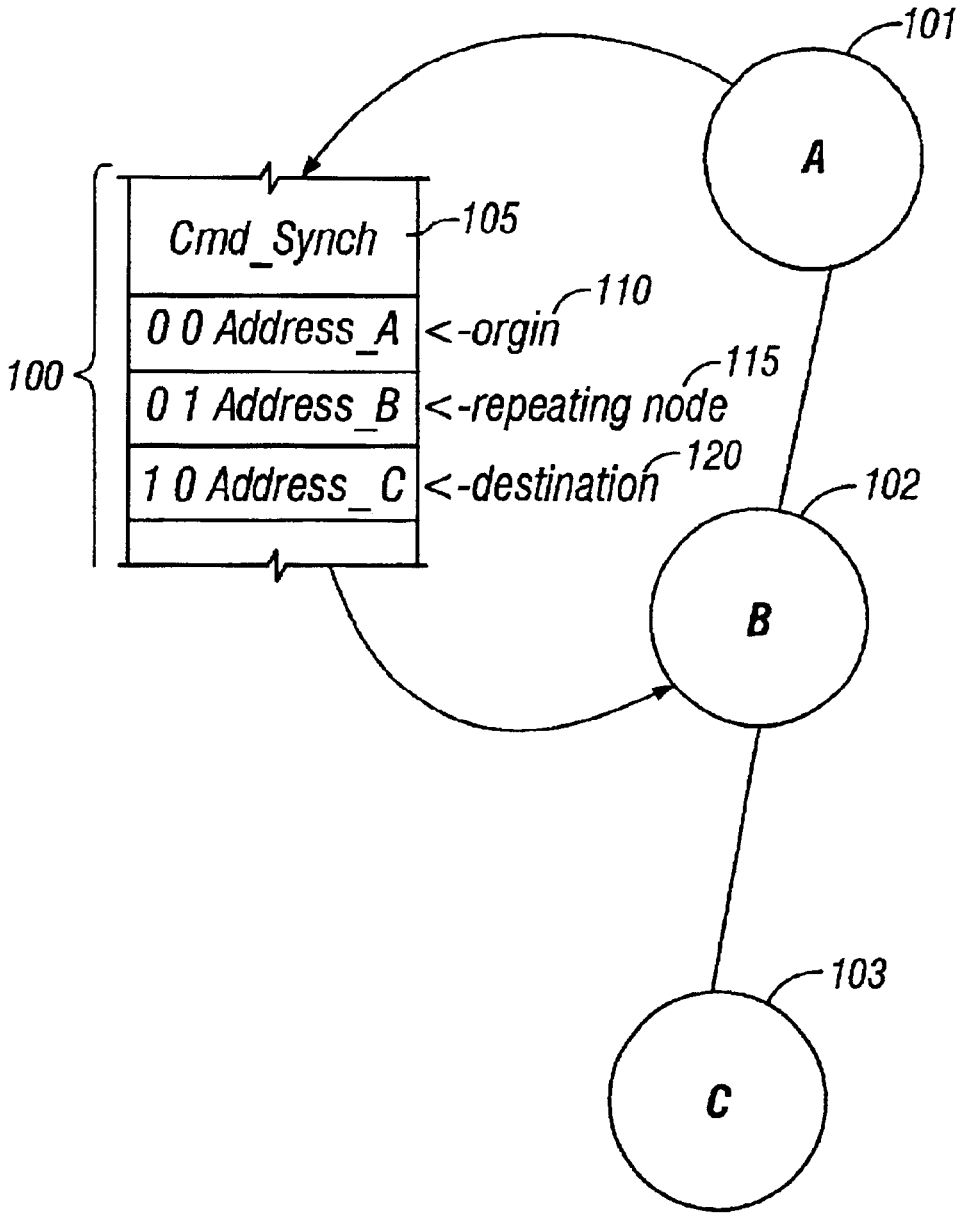
FIG. 3 is a schematic flow diagram of a command message transmitted from a master node to a slave node according to one embodiment of the present invention.
Figure 4:
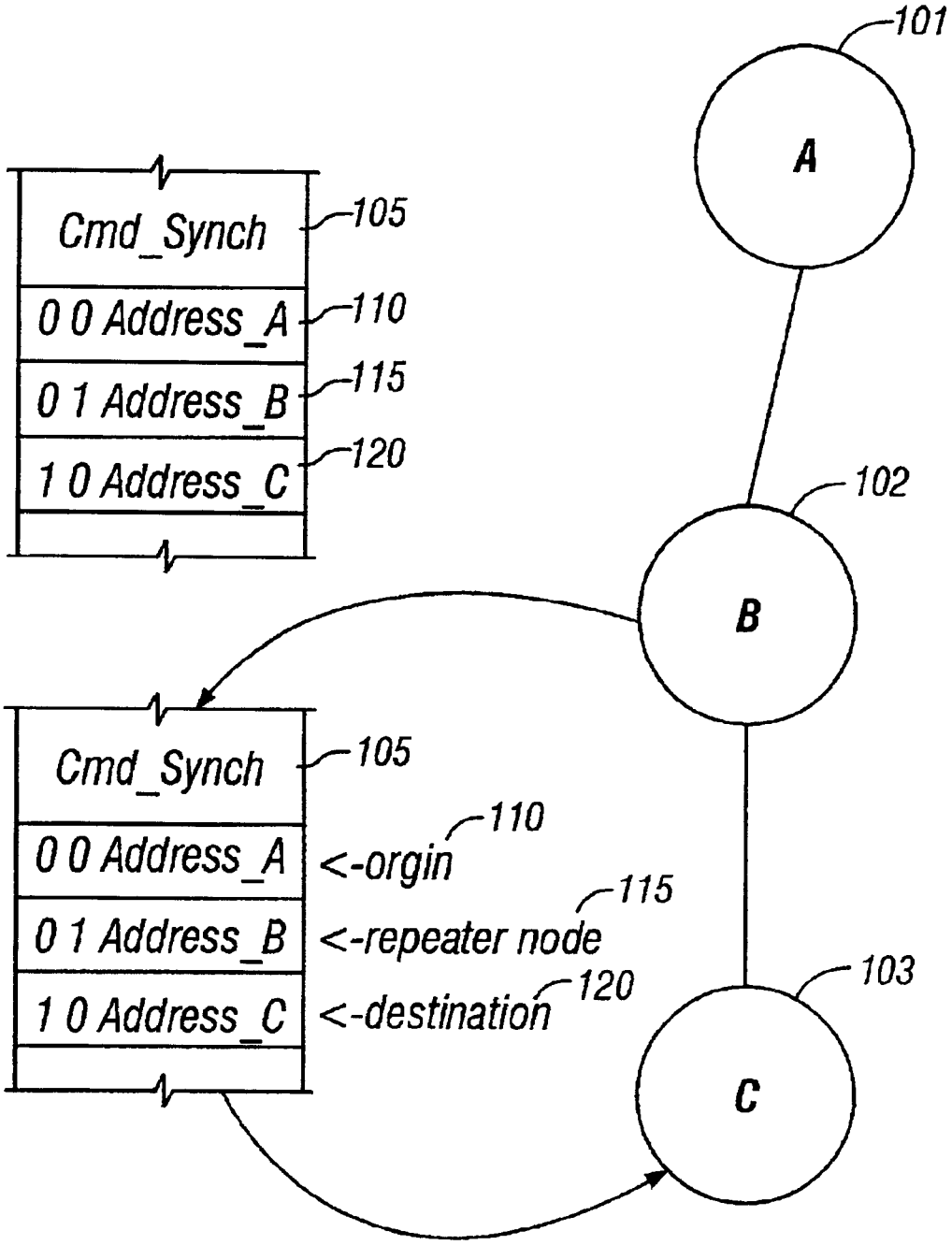
FIG. 4 is a schematic flow diagram of a command message transmitted from a slave/repeater node to a destination node according to one embodiment of the present invention.

With reference to FIGS. 1 and 2, each of the wells 2A, 2B and 2N associated with platform 1A include a plurality of zones which need to be monitored and/or controlled for efficient production and management of the well fluids. For example, with reference to FIG. 2, well number 2B includes three zones, namely zone number 3A, zone number 3B and zone number 3N. Each of zones 3A, 3B and 3N have been completed in a known manner. Zone number 3A has been completed using a known slotted liner completion, zone number 3B has been completed using an open hole selective completion and zone number 3N has been completed using a cased hole selective completion with sliding sleeves. Associated with each of zones 3A, 3B and 3N is a downhole control system 22. Similarly, associated with each well platform 1A, 1B and 1N is a surface control system 24.

As discussed, the multiwell/multizone control system of the present invention is comprised of multiple downhole electronically controlled electromechanical devices and multiple computer based surface systems operated from multiple locations. An important function of these systems is to predict the future flow profile of multiple wells and monitor and control the fluid or gas flow from the formation into the wellbore and from the wellbore to the surface. The system is also capable of receiving and transmitting data from multiple locations such as inside the borehole, and to or from other platforms 1A, 1B or 1N or from a location away from any well site such as central control center 10.

The downhole control modules 22 interface to the surface controller 24 using an electrical wire (i.e., hardwired) connection. Alternatively, data and command signals may be transmitted over optical fibers (not shown) using techniques known in the art. The modules 22 contain circuitry and processors which act according to programmed instructions to control the actuation of the downhole devices and sensors used in production wells. The downhole modules 22 in the wellbore can transmit and receive data and/or commands to or from the surface and/or to or from other devices in the borehole.

Surface controller 24 can control the activities of the downhole control modules 22 by requesting data on a periodic basis and commanding the downhole modules to open, or close electromechanical devices and to change monitoring parameters due to changes in long term borehole conditions.

Turning again to FIG. 2, an example of the downhole system is shown in an enlarged view of well number 2B from platform 1A depicting zones 3A, 3B and 3N. In zone 3A, a slotted liner completion is shown at 69 associated with a packer 71. In zone 3B, an open hole completion is shown with a series of packers 71 and intermittent sliding sleeves 75. In zone 3N, a cased hole completion is shown again with the series of packers 77, sliding sleeve 79 and perforating tools 81. The control system 22 in zone 3A includes electromechanical drivers and electromechanical devices which control the packers 69 and valving associated with the slotted liner so as to control fluid flow. Similarly, control system 22 in zone 3B include electromechanical drivers and electromechanical devices which control the packers, sliding sleeves and valves associated with that open hole completion system. The controller 22 in zone 3N also includes electromechanical drivers and electromechanical control devices for controlling the packers, sliding sleeves and perforating equipment depicted therein. Any suitable electromechanical driver or electromechanical control device may be used in connection with this invention to control a downhole tool or valve.

Information sent from the surface to a controller 22 may consist of actual control information, or may consist of data which is used to reprogram the memory in a downhole processor 50 (not shown) for initiating a control action based on sensor information. In addition to reprogramming information, the information sent from the surface may also be used to recalibrate a particular downhole sensor (not shown). Processor 50 may not only send raw data and status information to the surface, but may also process data downhole using appropriate algorithms and other methods so that the information sent to the surface constitutes derived data in a form well suited for analysis.

As is known in the communication art, long communication channels may suffer signal to noise degradation as the communication channel length becomes relatively long. This signal to noise degradation may result in reduced data rate. There is, therefore, a maximum transmission distance (MTD) for a desired data rate. When the distance from the surface controller to the intended destination controller exceeds the MTD, the present invention utilizes repeaters in the communication line to receive and retransmit the control message to the intended destination controller. The downhole controllers 22 in each production zone can act as repeaters for receiving and re-transmitting control signals. In the case where the distance from the surface controller to the uppermost production zone exceeds the MTD, repeaters 55 may be inserted in the production tubing string to receive and retransmit the signal.

It is of the utmost importance from both a production and a safety standpoint that the control message is acted on only by the intended destination controller. The present invention uses a transmission bus with a novel transmission protocol to ensure that the message is received and acted on only by the intended destination controller. The bus comprises a master node and multiple slave nodes communicating over one or more electrical and/or optical conductors. Such electrical and electro-optical cables are known in the art and are not described further. Each of the repeaters 55 and the controllers 22 are slave nodes on the bus. Each node has a unique identifying electronic address.

Referring to FIGS. 1 and 2, in a preferred embodiment, the surface controller 24 is designated as a master node and the repeaters 55 and controllers 22 are designated as slave nodes. The master sends command messages to a controller 22 to obtain data or to perform a particular function. When the distance between the master and the destination controller exceeds the MTD, the message is routed through another node physically located between the master and the destination node/controller 22. Note that controllers 22 can act as repeater nodes or they may be the destination node for the message. Repeater 55 can only act to repeat the message. The decision to use a particular slave node as a repeater can be made in the field. More than one repeater may be included in the transmission path. The routing information is contained in the header of the message. If a particular node is to repeat the message, then the header of the message will contain the address of that particular node, with the instruction to repeat the message to another node. Other nodes, whose addresses are not included in the header, ignore the message. As the message travels through each addressed repeater the routing information is changed, according to the predetermined protocol, but the destination address and the command message are not changed. The destination node receives, recognizes, and acts on the command message. The destination node then sends a response message to the master controller, using the same nodes as the command message, in reverse order.

FIGS. 3–7 show examples of the transmission protocol with the header 100 having a three address capacity, for use with a single repeater. In another preferred embodiment, the header 100 can accommodate more than three addresses and use more than one repeater. FIGS. 3–7 show an example of a three node system, where the master, node A 101 sends a command to node C 103, via a repeating node B 102. The command message header 100 contains a command synchronization string 105, an origin address 110, a repeater node address 115, and a destination address 120. The command synchronization string 105 is a unique string of bits which is prohibited from occurring as a command word or data word, and which is an exclusive bit string used to identify the following bits as a command message. Note that the order of the addresses in the header follows the order in which the message travels, in a from-to manner.

A routing string is present at the beginning of each address. The routing string contains at least one primary routing bit for designating the associated address as a destination node, and at least one secondary routing bit for designating the next node to receive and repeat/execute the command. In this preferred embodiment, the routing string comprises the first two bits of each address field. Here the primary bit is the first bit, and is used to indicate whether or not the associated address is a destination node. Here the term destination node means the node which will execute the command signal. If the primary bit is a one, the associated address is a destination node. Here the secondary bit is the second bit and designates the next node to receive and repeat/execute the command. The actual routing bit order may be reversed as long as the designation of the primary and secondary bits remains consistent. In other preferred embodiments, the routing information may be contained in any other predetermined length routing string with at least one primary bit and at least one secondary bit. Such strings may include, but are not limited to a nibble (4 bits) or a byte (8 bits).

In operation, a command message, with header, is transmitted on the communication bus and is recognized by the nodes with the appropriate addresses. Node B 102 receives the message and interprets the routing string to determine that it is to retransmit the command message to node C 103. Node B 102 reconfigures the routing string according to the protocol (see FIG. 4), and transmits the signal to node C 103 which executes the command as directed. Node C 103 responds with a confirmation that the command has been executed.

Figure 5:
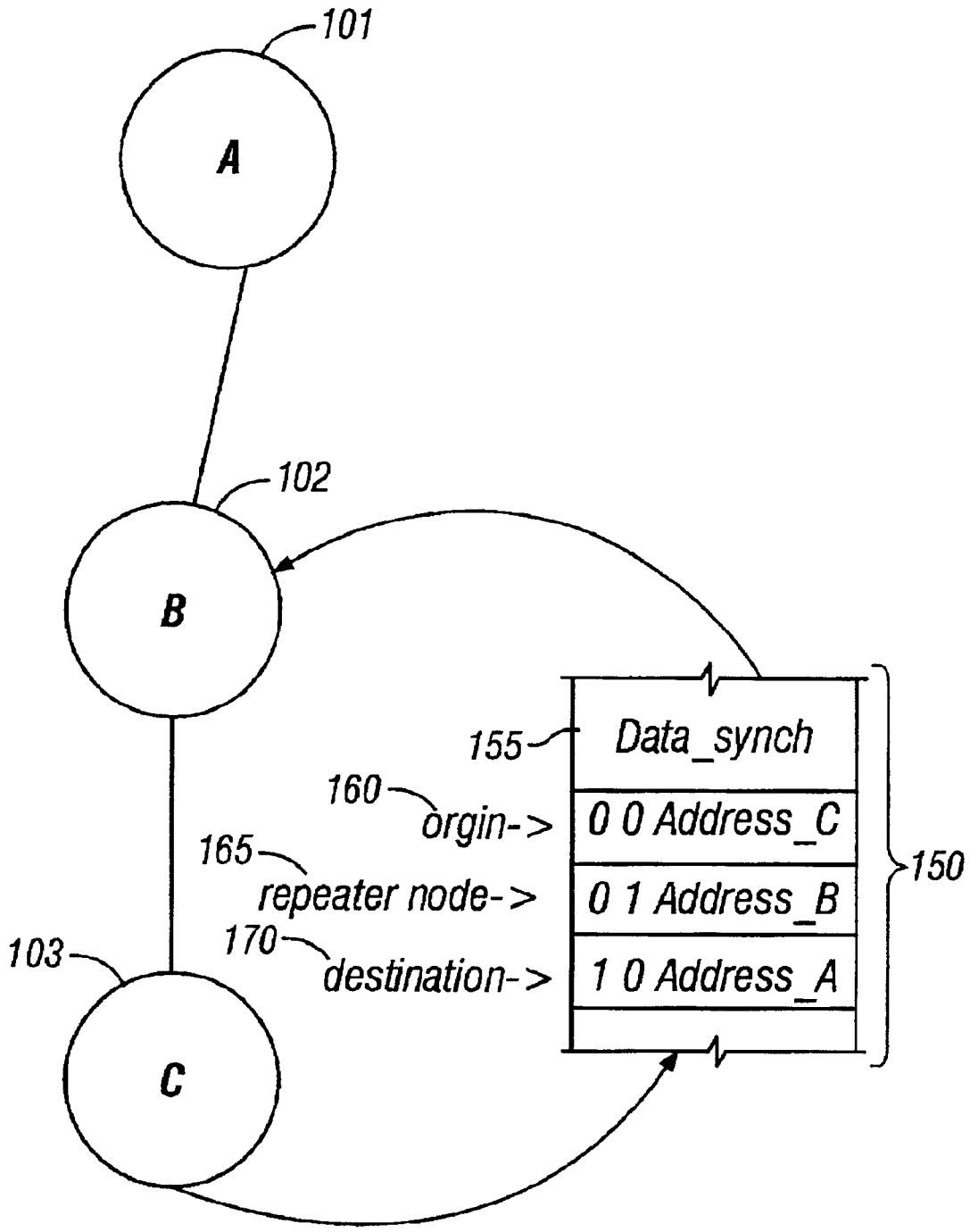
FIG. 5 is a schematic flow diagram of a response message from a destination node to a slave/repeater node according to one embodiment of the present invention.
Figure 6:
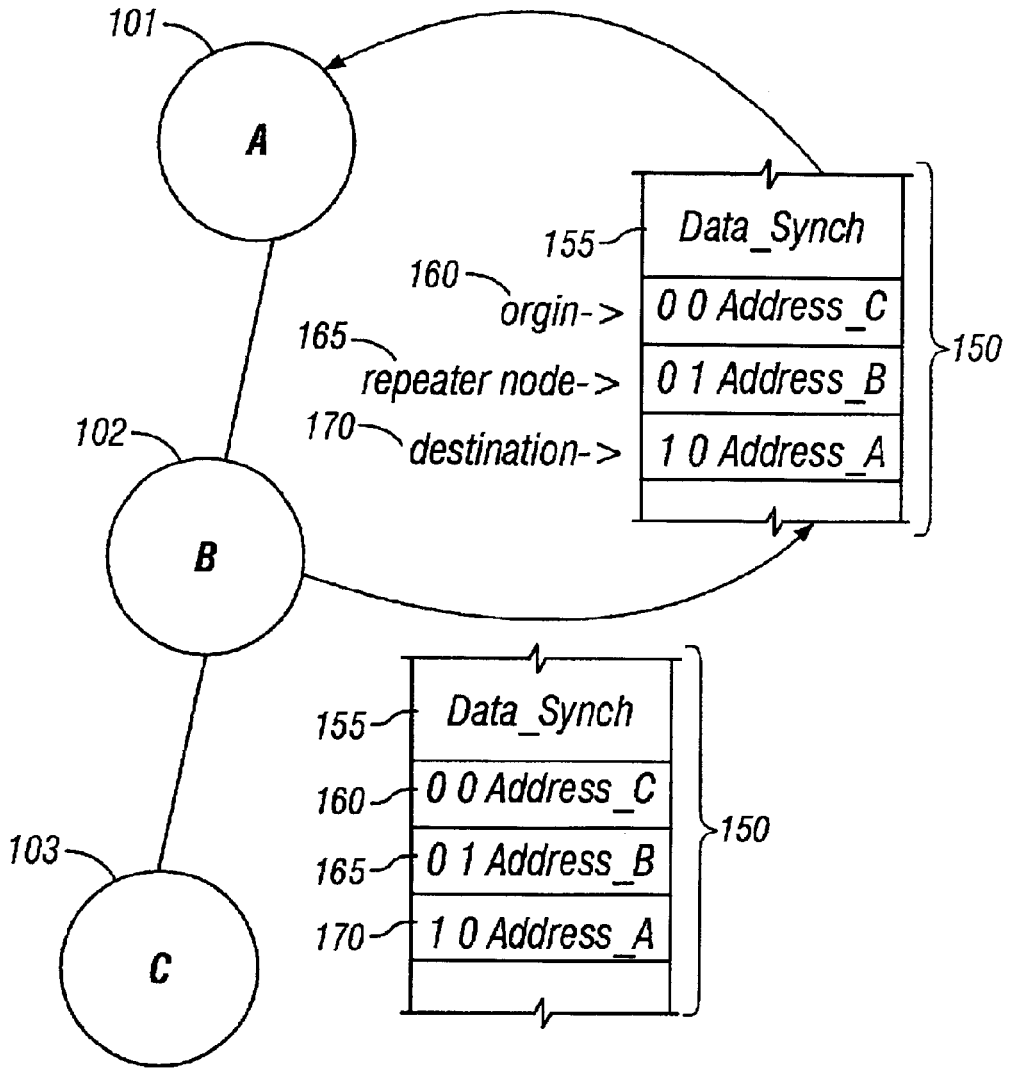
FIG. 6 is a schematic flow diagram of a response message from a slave/repeater node to a master node according to one embodiment of the present invention.

This response message could be a status flag, a sensor reading, downhole processed data, or any other suitable evidence of command execution. Node C reconfigures the header by retracing the node order of the command message 100, changes the routing string, and replaces the command synchronization string 105 with a unique data synchronization string 155, as shown in FIG. 5. The data synchronization string 155, like the command synchronization string 105, is also prohibited from occurring as a command or data word. The response message is sent from node C 103 to node B 102. Node B 102 interprets the routing string to determine that the message is to be retransmitted. Node B 102 changes the routing string, according to the routing protocol, see FIG. 6, and retransmits the message to node A 101, thereby completing the transmission sequence.

Figure 7:
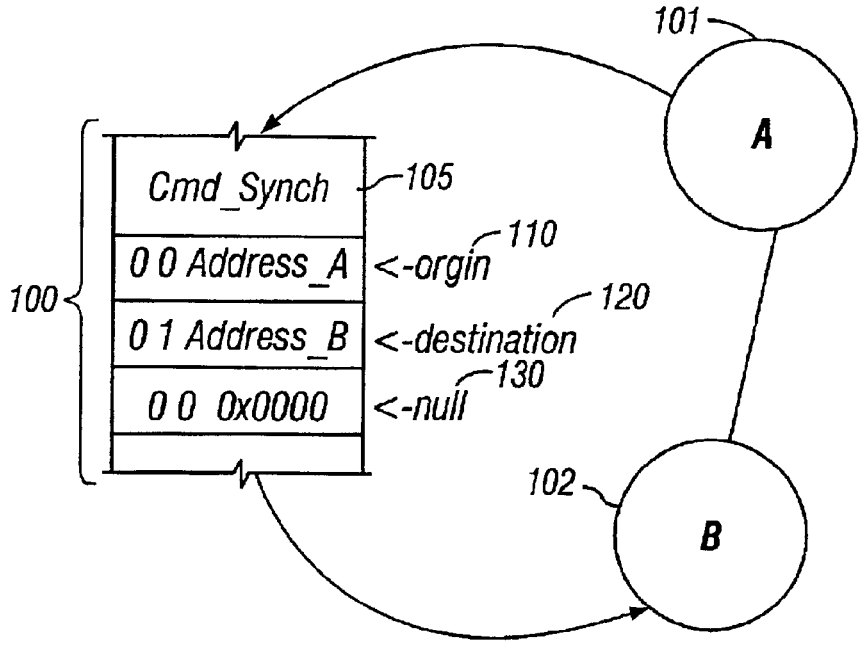
FIG. 7 is a schematic flow diagram of a command message from a master node to a destination node according to one embodiment of the present invention.
Figure 8:
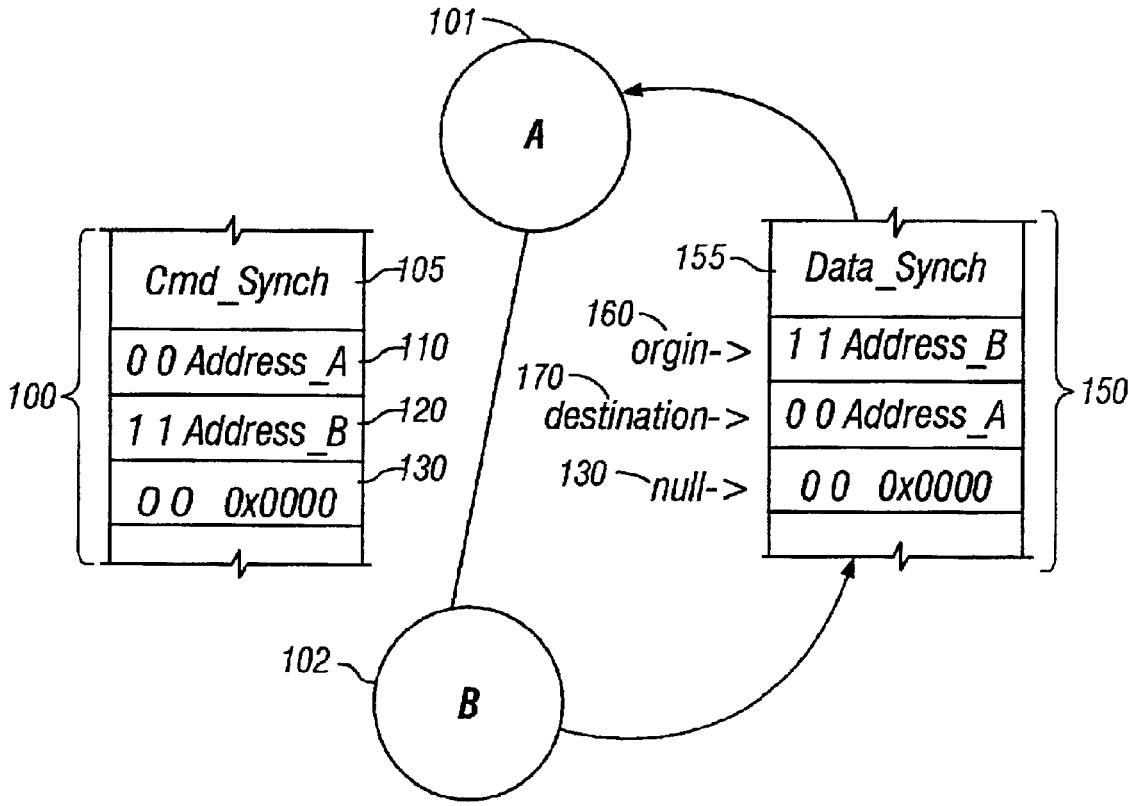
FIG. 8 is a schematic flow diagram of a response message from a destination node to a master node according to one embodiment of the present invention.

FIGS. 7 and 8 illustrate the case where no repeater is required to transmit the signal from the surface controller 24 to a particular downhole controller 22. The command message header 100 contains a command synchronization string 105, an origin address 105, a destination address 120, and a null address 130. As discussed before, the routing string in this embodiment is contained in the first two bits of each address. The response message header 150 contains a data synchronization string 155, an origin address 160, a destination address 170, and a null string 130. Here the null string is used to maintain the header length for a single repeater header format and can be the same string for both the command and the response messages. In another preferred embodiment, n repeaters may be incorporated in the header format. In that case, for a direct communication as illustrated in FIGS. 7 and 8, n null strings 130 would be attached to the header after the destination address 120.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method for controlling production from a formation having at least one producing well disposed therein, said at least one producing well having a plurality of producing zones, comprising;

a. installing a flow control device, having a controller coupled thereto, proximate each of said plurality of producing zones, each said controller having a predetermined communication address, each said controller adapted to act as a repeater on command from a surface controller;

b. connecting each said controller to a transmission bus, said transmission bus being connected to said surface controller;

c. transmitting a command message from said surface controller to a predetermined controller downhole, said command message designating a predetermined path along said transmission bus according to a predetermined protocol;

d. receiving said command message by said predetermined controller; and e. executing said command message to control said flow control device.

2. The method of claim 1, further comprising;

i. transmitting a response message from said predetermined controller to said surface controller using the predetermined protocol along the predetermined path in a reverse direction;

ii. receiving the response message at the surface controller;

iii. using the response message, according to programmed instructions, to control well production.

3. The method of claim 2, wherein the predetermined protocol comprises a routing string for identifying which controller is to act as a repeater for the command message and the response message.

4. The method of claim 3, wherein the routing string designates which controller is a destination for the command message.

5. The method of claim 1, wherein the transmission bus comprises one of (i) at least one electrical conductor and (ii) at least one optical conductor.

6. The method of claim 1, wherein executing the command message further comprises using a set of instructions in the command message in combination with programmed instructions in the predetermined controller.

7. The method of claim 1, wherein the flow control device comprises at least one of (i) a packer, (ii) a sliding sleeve, (iii) a valve, (iv) a perforating system, and (v) a slotted liner.

8. The method of claim 1, wherein the plurality of completion zones comprises at least one lateral completion zone.

9. A method of two way communication between a surface controller and a downhole location in an intelligent well completion system, said intelligent well completion system having a surface platform and a plurality of producing wells, wherein each of the plurality of producing wells has a plurality of producing zones, a flow control device with a controller coupled thereto disposed proximate each producing zone, a transmission bus connecting the surface controller and each downhole controller, each downhole controller having a unique communication address, the method comprising;

a. transmitting a command message on the transmission bus from said surface controller, said command message comprising a command header string and a command instruction string, said command header string comprising a command origin address, at least one repeater address, and a command destination address, each of said addresses further containing a routing string identifying the nature of said address, said command message following a command routing path on the transmission bus designated by said routing string;

b. receiving the command message at the downhole controller designated as a repeater by the at least one repeater address designated in the header string;

c. using programmed instructions for modifying the routing string to direct the command message to a command destination downhole controller;

d. using the downhole controller designated as a repeater for relaying the command message to the command destination downhole controller;

e. receiving the command message at the designated command destination downhole controller;

f. executing the command message at the command destination downhole controller, said command destination downhole controller located at said downhole location; and, g. transmitting a response message from the command destination downhole controller on the transmission bus.

10. The method of claim 9, further comprising;

i. transmitting a response message on the transmission bus from said destination downhole controller, said response message comprising a response header string and a data string, said response header string comprising a response origin address, at least one repeater address, and a response destination address, each of said addresses further containing a routing string identifying the nature of said address, said response message following a response routing path designated by said routing strings;

ii. receiving the response message at the downhole controller designated as a repeater in the response header string;

iii. using programmed instructions for modifying the routing string to direct the response message to a response destination controller;

iv. using the downhole controller designated as a repeater for relaying the response message to the response destination controller;

v. receiving the response message at the designated response destination controller, said response destination node being said surface controller;

vi. using the response message according to programmed instructions to control well production.

11. The method of claim 10, wherein executing the command instruction string further comprises using the set of instructions in the command instruction string in combination with preprogrammed instructions in the downhole controller.

12. The method of claim 9, wherein the command header string further comprises a command synchronization string, said command synchronization string being a unique bit string of predetermined length, said bit string being prohibited from occurring as a command word, a data word, or a response word, thereby identifying the accompanying message as a command message.

13. The method of claim 9, wherein the routing string comprises at least one primary routing bit and at least one secondary routing bit.

14. The method of claim 13, wherein the at least one primary routing bit designates a controller address as a destination node when said primary routing bit is a one, otherwise the node address is not designated as a destination address.

15. The method of claim 13, wherein the at least one secondary routing bit designates the controller address as the next controller to receive the command message when the at least one secondary routing bit is a one.

16. The method of claim 10, wherein the response synchronization string is a unique bit string of predetermined length, said bit string being prohibited from occurring as a command word, a data word, or a response word, thereby identifying the accompanying message as a response message.

17. The method of claim 9, wherein the at least one repeater address is a null string, said null string designating that no repeater is used to transmit the command message and the response message.

18. The method of claim 10, wherein the response message follows a response routing path utilizing the repeater addresses of the command routing path but in reverse order.

* * * * *